US011603173B2

(12) United States Patent
Brunier et al.

(10) Patent No.: US 11,603,173 B2
(45) Date of Patent: Mar. 14, 2023

(54) DEVICES, SYSTEMS AND METHODS FOR MONITORING, RECORDING AND COMMUNICATION OF VESSEL INFORMATION

(71) Applicant: NAUTI-TECH INC., Fort Lauderdale, FL (US)

(72) Inventors: Jack Brunier, Fort Lauderdale, FL (US); James Posillico, Tamarac, FL (US); Philippe Mortelette, Margate, FL (US)

(73) Assignee: NAUTI-TECH INC., Fort Lauderdale, FL (US)

( * ) Notice: Subject to any disclaimer, the term of this patent is extended or adjusted under 35 U.S.C. 154(b) by 379 days.

(21) Appl. No.: 16/789,108

(22) Filed: Feb. 12, 2020

(65) Prior Publication Data

US 2020/0255102 A1 Aug. 13, 2020

Related U.S. Application Data

(60) Provisional application No. 62/804,530, filed on Feb. 12, 2019.

(51) Int. Cl.

| | |
|---|---|
| ***B63B 79/30*** | (2020.01) |
| ***B63B 79/40*** | (2020.01) |
| ***G07C 5/08*** | (2006.01) |
| ***G07C 5/00*** | (2006.01) |

(52) U.S. Cl.

CPC ..... *B63B 79/30* (2020.01); *B63B 79/40* (2020.01); *G07C 5/008* (2013.01); *G07C 5/0816* (2013.01); *G07C 5/0841* (2013.01)

(58) Field of Classification Search

CPC ..... B63B 79/30; B63B 79/40; G07C 5/008; G07C 5/0816; G07C 5/0841

See application file for complete search history.

(56) References Cited

U.S. PATENT DOCUMENTS

| | | | | |
|---|---|---|---|---|
| 8,634,975 | B2 | 1/2014 | Chen et al. | |
| 2010/0138104 | A1 | 6/2010 | Knoska et al. | |
| 2011/0257819 | A1* | 10/2011 | Chen | H04Q 9/00 701/21 |

FOREIGN PATENT DOCUMENTS

| | | | |
|---|---|---|---|
| EP | 0 921 411 | A2 | 6/1999 |
| WO | 2004092765 | A1 | 10/2004 |
| WO | 2006123367 | A1 | 11/2006 |

* cited by examiner

*Primary Examiner* — Yuen Wong

(74) *Attorney, Agent, or Firm* — FisherBroyles, LLP; Joseph F. Posillico

(57) ABSTRACT

The present disclosure relates to systems and methods for continuous monitoring and control of the vessel performance and history of a vessel, and is configured for use with multiple wide-area network (WAN) interfaces. The disclosed systems can use multiple vessel system interfaces and inputs and outputs to log, report, and transmit vital information via a computer program that adapts to weighted metrics and WAN availability. This can help ensure that prioritized data always is sent first; while ancillary and auxiliary data are sent later through a transmission medium that is directed, timely, and fiscally responsible. Thus, real-time data can be processed to hasten repairs or troubleshooting, and long-term data can be analyzed for safety and nominal operation of machinery.

7 Claims, 7 Drawing Sheets

DRAWINGS

General overview of system input/output

Event handler module data flowchart

Transmission module data flowchart

Archive module data flowchart

DEVICES, SYSTEMS AND METHODS FOR MONITORING, RECORDING AND COMMUNICATION OF VESSEL INFORMATION

REFERENCE TO RELATED APPLICATIONS

The present application is related to and claims the priority benefit of U.S. Provisional Application 62/804,530, filed Feb. 12, 2019, which is incorporated herein by reference in its entirety.

FIELD OF INVENTION

The present disclosure relates to devices, systems, and methods for selective and continuous monitoring and control of performance and history parameters of a vessel, particularly a sea-going vessel during operation, and can be used with multiple wide-area network ("WAN") interfaces.

BACKGROUND

Almost all vessels, e.g., ships, today have a multitude of sensors that monitor vessel performance during operation, for example, while at sea. Also, the most basic of engines are capable of outputting pertinent information relating to the performance and health thereof. On larger vessels, whole communications networks and a multitude of sensors bring vessel-related data to the bridge or other locations on-board. This data typically comes in different formats, and these independent systems generally do not talk to one another. The evaluation of this data usually needs to happen in real-time or near real-time, by the captain or engineers present on the vessel while it is in operation. However, these same individuals as this time have numerous other responsibilities directed to navigation and safe operation of the vessel. Thus, it is generally not possible for on-board personnel to fully account for, pick-out and assess critical data from a high volume of data that is available real time, especially when at any given time much of this data may be superfluous or, non-essential. Also, this data has heretofore usually not been logged, and if it is logged it has heretofore usually not been transmitted to a place where it can be used to make beneficial decisions for the life of the machinery and the souls onboard. Even when transmitted, the data usually is only a part of what is necessary to make sound calls on part replacements, health, and performance.

Applicants have come to appreciate that dramatic improvements can be made in safe and effective operation of vessels by using the methods described herein to, inter alia, obtain and selectively transmit data to off-vessel resources. A consideration that makes it difficult to achieve the results achieved herein is the current state of WAN interfaces present on vessels. Most larger vessels have some sort of stabilized antenna or other satellite interface. This method of off-vessel transmission can be extremely expensive, and the integrity of the connection can be highly dependent on the weather and other ambient conditions, e.g., sea conditions. Many vessels currently have some level of cellular modem onboard, and this may enable the crew to offload some data when near shore. Nevertheless, the most prevalent, secure, and stable connections come from a physical cable medium or WIFI link to shore.

Applicants are unaware of any monitoring devices that take into consideration the bandwidth limitations, connection stability, or fiscal properties of a vessel's transmission methods. Applicants are unaware of any devices or systems that provide real-time management and tracking of system-wide data in a small affordable package. Current systems that provide such system-wide data are expensive, and usually require multiple third party devices to help in the conversion of data to a primary integration point and/or do not provide the important advantages or achieve the results of applicants' invention as described herein. See, for example, U.S. Pat. No. 8,634,975; WO 2006/123367; US 2010/0138104; WO 2004/092765; and EP 0921411. For example, applicants are unaware of any know devices, systems or methods that operate based on and/or make real-time adjustments accounting for payload size, and urgency dependence, and/or real-time transmission method availability. Applicants are unaware of any devices or systems that conduct selective logging and tracking of conditions in real-time in response to changing conditions, including for example changing signal transmission options.

SUMMARY

The present invention includes systems and methods that aggregate on-board data from multiple interfaces relating to vessel health and performance, on-board converting and logging of the data, and modulating and controlling transmission of the data based on predetermined and adjustable criteria, including the urgency and criticality of the data, the method(s) and systems available for off-vessel transmission of data, and fiscal metrics.

The term "vessel," as used herein, is intended to encompass ships; boats; aircraft; land-based vehicles such as automobiles, buses, and trucks; and the like. The systems can log data from a plurality of sensors and existing communications networks onboard the vessels, such as digital and analog I/Os, CANbus, NMEA2000, J1939, RS485, RS232, WAN, WIFI, Bluetooth, and the like. The data can be parsed, converted to a single protocol, sorted based on a variety of metrics, and then checked against the availability of various transmission methods. In this way, it is possible to transmit critical data in real-time or near real-time; while non-critical and auxiliary data can be transmitted by lower cost and/or lower reliability means and/or stored for later transmission by a more fiscally and timely transmission method, or when requested. This can provide a real-time or near real time flow of critical data, while allowing for the automatic build up and subsequent transmission of valuable data that can be used for nominal vessel performance and maintenance.

The present invention includes apparatus embodiments that include one or more sensors located on-board the vessel, an on-board computer system in communication with said one or more sensors, and at least one system/devise for sending transmissions of data off-vessel to an off-vessel communication system. Generally, the sensor provides signals representative of one or more aspects of the vessel while in operation and/or the environment around the vessel. The computer system is connected to the sensor system and is configured to receive the data from the sensor system. Importantly, the computer system also is configured to assess the data and assign an importance metric to the different data received from the sensors. The computer system is also configured monitor and asses possible off-vessel transmission methods available at a given time, and then the amount of data to be transmitted, the type and time of transmission method to be used is determined, and based on this determination the selected data is transmitted from the vessel to the one or more off-vessel communications systems. Preferably, the present on-vessel system also includes and is configured to receive information from the off-vessel communication system.

The present invention thus includes a system for gathering information about the performance while in-transit of an operating vessel and transmitting off-vessel at least a subset of the gathered information comprising:

an on-board memory device;

an on-board processor communicatively coupled to the memory device;

an on-board transmitter communicatively coupled to the processor;

computer executable instructions stored on the memory device, wherein the computer-executable instructions are configured so the computer executable instructions, when executed on the processor, cause the system to:

receive the information about the performance of the vessel;

prioritize the information for transmission over a WAN based on first criterion;

determine the availability and quality of one or more means for off-vessel transmitting the information; and determine whether the information is to be transmitted on a real-time or near real-time basis based on a second criterion.

The present invention also includes a device located on-board an operating vessel, said device comprising:

a non-transitory computer readable medium having stored thereon computer implementable instructions executable by a processor in a computing device to:

receive information about vessel performance while the vessel is in operation and in transit;

prioritize the information for transmission over a WAN based on first criterion;

determine the availability of means for off-vessel transmitting the information; and determine whether the information is to be transmitted on a real-time or near real-time basis based on a second criterion.

The present invention also includes methods for gathering information about the performance while in-transit of an operating vessel and transmitting off-vessel at least a subset of the gathered information, said method comprising:

(a) providing on-board a monitoring system communicatively coupled to one or more on-board vessel sensors, said system comprising:

(i) a memory device;

(ii) a processor communicatively coupled to the memory device;

(iii) a transmitter communicatively coupled to the processor; and (iv) computer executable instructions stored on the memory device, (b) executing said executable instructions on the processor, whereby said execution causes the system to:

(i) receive the information from the one or more sensors about the performance of the vessel;

(ii) prioritize the information for transmission over a WAN based on first criterion to produce a subset of high priority information;

(iii) determine the availability and quality of one or more means for off-vessel transmitting the information; and (iv) determine whether the high priority information is to be transmitted off-vessel on a real-time or near real-time basis based on a second criterion; and (c) transmitting or not at least said high priority data off-vessel in accordance with said executing step (b).

DETAILED DESCRIPTION

Figure 1:
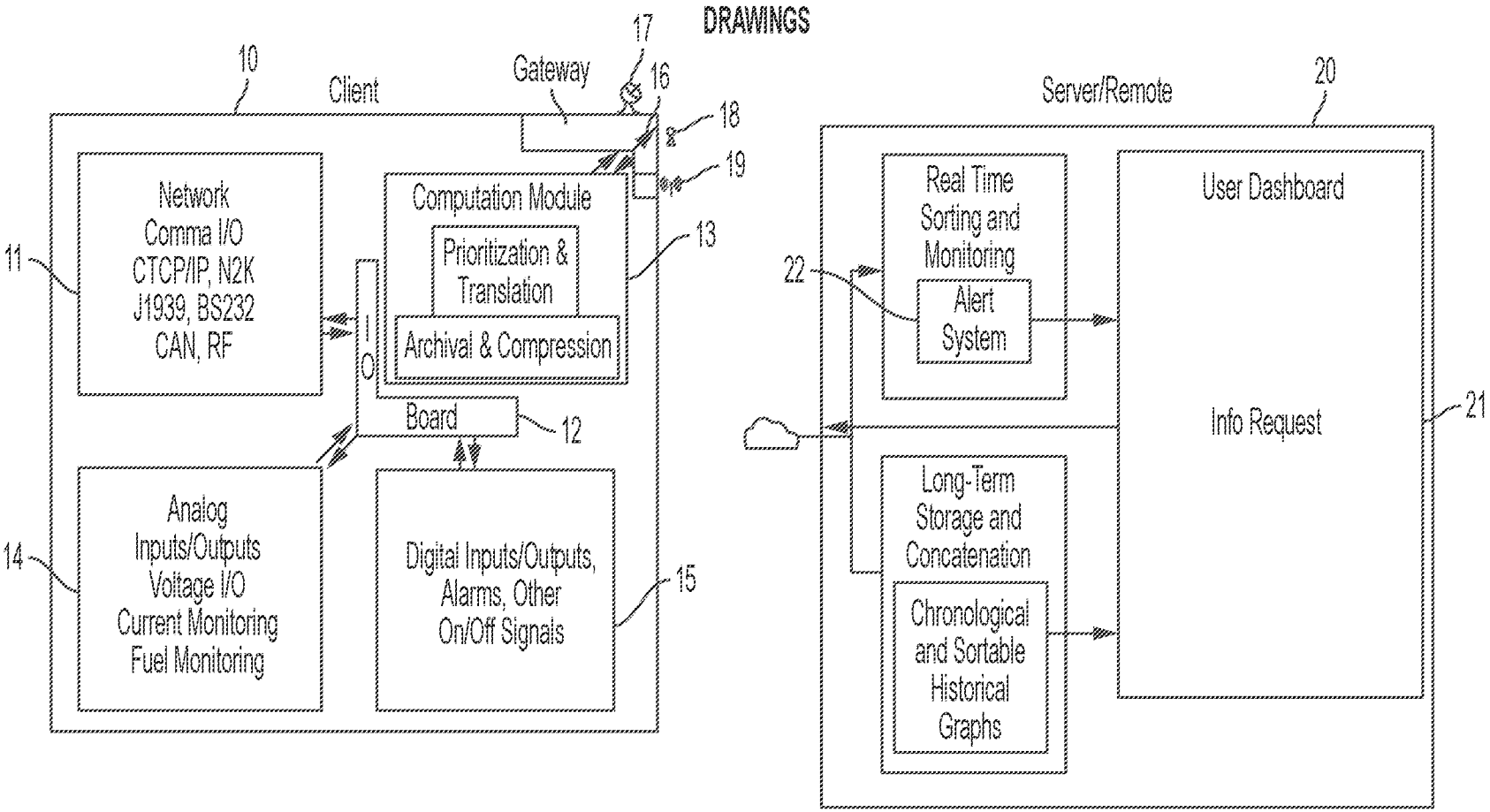
FIG. 1 is a schematic flow chart of system input/output according to one embodiment of the present invention.

The disclosed devices, systems, and methods preferably automatically gather information about the vessel while it is in transit operation, such as messages and signals being present across multiple inputs and outputs, and then creating a "snapshot" of the data using network communication protocols. Once gathered and listed, this information is automatically assigned in real-time or near real time an importance metric, and one or more conditional states that would qualify for transmission candidacy.

Vessels according to the present invention may include, for example, without limitation, cargo ships, passenger ships, military ships, leisure craft, sub-surface ships, and/or any other suitable vessel.

The vessels according to the present invention include one or devices or sensors that are able to monitor the vessel, including conditions and the performance of various components or sub-parts thereof, and preferably include sensors to monitor the environment and location of vessel (e.g., weather and GPS coordinates) during a voyage and/or while the vessel is between ports. The vessel includes devices configured and able to provide bi-directional communication between a vessel and an off-vessel communication network, which in turn can communicate with an off-vessel (preferably on-shore) server and/or human expert. The bi-directional communication may be, for example, a short text and/or data 30 messaging system.

The on-vessel power used to operate the computer, network and communication systems and components may include, without limitation, alternating current (AC) or direct current (DC) electric power, a battery, ultra-capacitor, fuel cell, gas powered generator, photo cells, and/or any other suitable electrical power.

The on-vessel communication may be provided, for example, via a local area network (LAN).

The remote (off-vessel) server may be any type of data processing system configured to send and receive data over the appropriate communication network, and may include programs for vessel voyage planning, and may be a mobile command station onboard another vessel or platform in some embodiments. Alternatively, the remote server 118 may be connected to a land-based satellite station via, for example, a wireless, cabled, or internet connection.

Optionally but preferably, users onboard the vessel can initiate transmission of reports, requests, or alerts to the remote server.

Optionally but preferably, the present systems may also be configured to operate while the vessel is at a port, that is, not in travelling/transport operation.

The processor unit executes instructions for software that may be loaded into memory, and may be a set of one or more processors or may be a multiprocessor core, depending on the particular implementation. Further, the processor may be implemented using one or more heterogeneous processor systems in which a main processor is present with secondary processors on a single chip. As another illustrative example, the processor unit may be a symmetric multiprocessor system containing multiple processors of the same type.

As used herein, the terms "memory," "memory storage" and the like means any piece of hardware that is capable of storing information, such as, for example without limitation, data, program code in functional form, and/or other suitable information either on a temporary basis and/or a permanent basis. Memory thus may be, for example, a random access memory or any other suitable volatile or non-volatile storage device. Persistent storage (also referred to as long-term storage) may take various forms depending on the particular implementation. For example, persistent storage may be a hard drive, a flash memory, a rewritable optical disk, a rewritable magnetic tape, 25 or some combination of the above. The media used for persistent storage also may be removable.

The on-board communications network can, for example, provide communications with other data processing systems or devices on board the vessel. For example, the on-board communication may include a network interface card and may provide communications through the use of either or both physical and wireless communications links.

Input/output devices may include a connection for user input through a keyboard, a mouse, and/or some other suitable input device. Further, input/output units may send output to a printer or to a display device.

Instructions for the operating system, applications and/or programs may be located in storage devices, which are in communication with the processor unit. These instructions may be loaded into memory for execution by the processor unit. These instructions are sometimes referred to as program code, computer usable program code, or computer readable program code that may be read and executed by a processor in processor unit. The program code in the different embodiments These on-board signals used in accordance with the present invention may be transmitted over communications links, such as wireless communications links, optical fiber cable, coaxial cable, a wire, and/or any other suitable type of communications link.

The on-board communications network may include one or more devices used to transmit and receive data, such as a modem or a network adapter.

The inputs to the present on-board system can include, for example, voltage, current, 4 to −20 ma, analog inputs and outputs, digital inputs and outputs, and digital protocols including but not limited to TCP/IP, RS232, CAN, CAN-Open, J1939, NMEA2K, NMEA0183. In preferred embodiments, the devices, systems, and methods constantly poll transmission methods for availability and quality through interface, route, gateway, MAC address and/or some other unique identifier. When messages qualify for transmission, they are checked against the transmission methods that are currently available. If the urgency, condition of the message, and transmission method are all acceptable in accordance with the predetermined values specified by the user according to the particular vessel involved (preferable prior to the start of the voyage), then the message is sent in accordance with the teachings contained herein to via the selected transmission method or saved for later transmission if the decision matrix so dictates.

Current real-time data messages that qualify for transmission but do not meet transmission method requirements can be requested from remote site and/or by an end user for a specified amount of time, for urgent time sensitive data analysis and reporting.

The configuration of defined flags, conditions, transmission periods, and allowed WAN methods can all preferably all be configured remotely. Also remotely configurable is the ability to redirect outgoing traffic on the fly to another user or remote server.

All non-excluded inputs and values regardless of condition or transmission method are archived, compressed, and split into pieces if necessary to facilitate transfer over less than optimal conditions.

The transmission of compressed data is preferably reserved for appropriate transmission methods, and can begin as soon as the appropriate transmission method is available. Transmission of the compressed data also can be requested from a remote site, and such transmission can be initiated regardless of the type of transmission method available at the time, for urgent time-sensitive data analysis.

The device files can be encrypted, and the contents thereof can be made to remain secure in events of power loss or attempted tampering.

The data provided by the disclosed systems can be used to present end-users with real-time or near real-time monitoring and historical graphs using past recorded and transmitted data. The data can also be analyzed to provide routine maintenance scheduling, safety data, as well as performance gains or loss.

The disclosed devices, systems, and methods can be used in aviation, automotive, marine, and other applications. Examples of possible types of uses include real-time or near real time notification, monitoring, and logging of critical and non-critical systems, for example, real-time alarms and notifications of engine and oil temperature, oil pressure, air temperature, wind speeds, SOG, and fuel levels (including of mid-voyage boats and ships and mid-flight airplanes); long-term recording and transmission of entire voyage performance and statistics upon landing; real-time alarms and notification of high water alarms, propeller RPM's, fuel levels, and GPS for mid-trip ships and vessels; long term recording and transmission of entire trip performance and statistics when at shore; automotive real-time notifications of accidents while driving; and firmware upgrade downloads and vehicle usage statistic uploads when parked.

Example 1

An embodiment of the invention is implemented in which the client is an ocean-going vessel having the ability to transmit data, depending on conditions and position, via satellite, cellular and WiFi. During its transit operations the vessel traverses a course during which it will have the following off-vessel data transmission capabilities/qualities for each of the possible data transmission possibilities:

TABLE 1

| Zone | Satellite | Cellular | WiFi |
|---|---|---|---|
| 1 | Yes-good | Yes-good | Yes-good |
| 2 | Yes-good | Yes-good | Yes-poor |
| 3 | Yes-good | Yes-Fair | Yes-Fair |
| 4 | Yes-fair | Yes-poor | Yes-poor |
| 5 | No | Yes-poor | Yes-good |
| 6 | No | Yes-poor | No |

The operation is now described in connection with FIGS. 1-4. The sea-going vessel is the client 10 and includes on-board various communication/data networks 11, an input output board 12 and a computation module 13 (preferably contained within a desktop, laptop or other user friendly computer configuration). The board 12 is in input and output communication with networks 11 and computation module 13, and includes analog and digital input/outputs 14 and 15. Board 13 is also in communication with a gateway 16 that leads to each of off-vessel transmitter/receivers 17 (satellite), 18 (cellular) and WiFi (19).

The analog input in this example is connected to a sensor for each of following engine vessel parameters and ship parameters: (a)—engine oil pressure; (b) engine temperature; (c) rudder control hydraulic pressure. For the purposes of this example, the sensor values are reported on a scale of 100, with values of 0-25 being critically low, 25-40 being low; 40-60 being normal; 60-75 being high; and 75-100 being critically high.

In addition, the gateway 16 monitors performance quality for each of the off-vessel transmitter/receivers 17-19 and communicates this data to computation module 13 as reported in Table 1 above.

Figure 2:
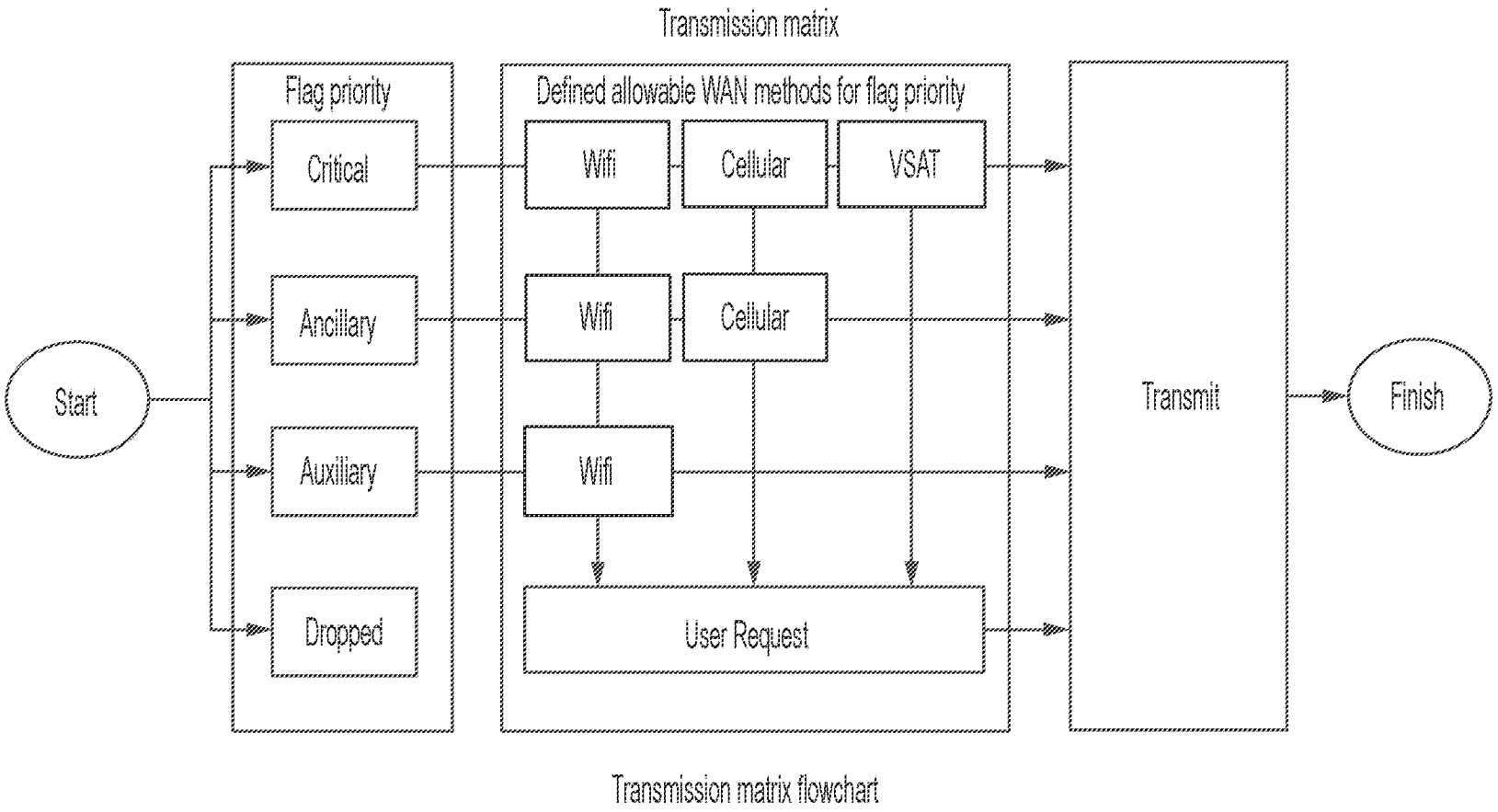
FIG. 2 is a schematic transmission matrix flow chart according to one embodiment of the present invention.
Figure 3A:
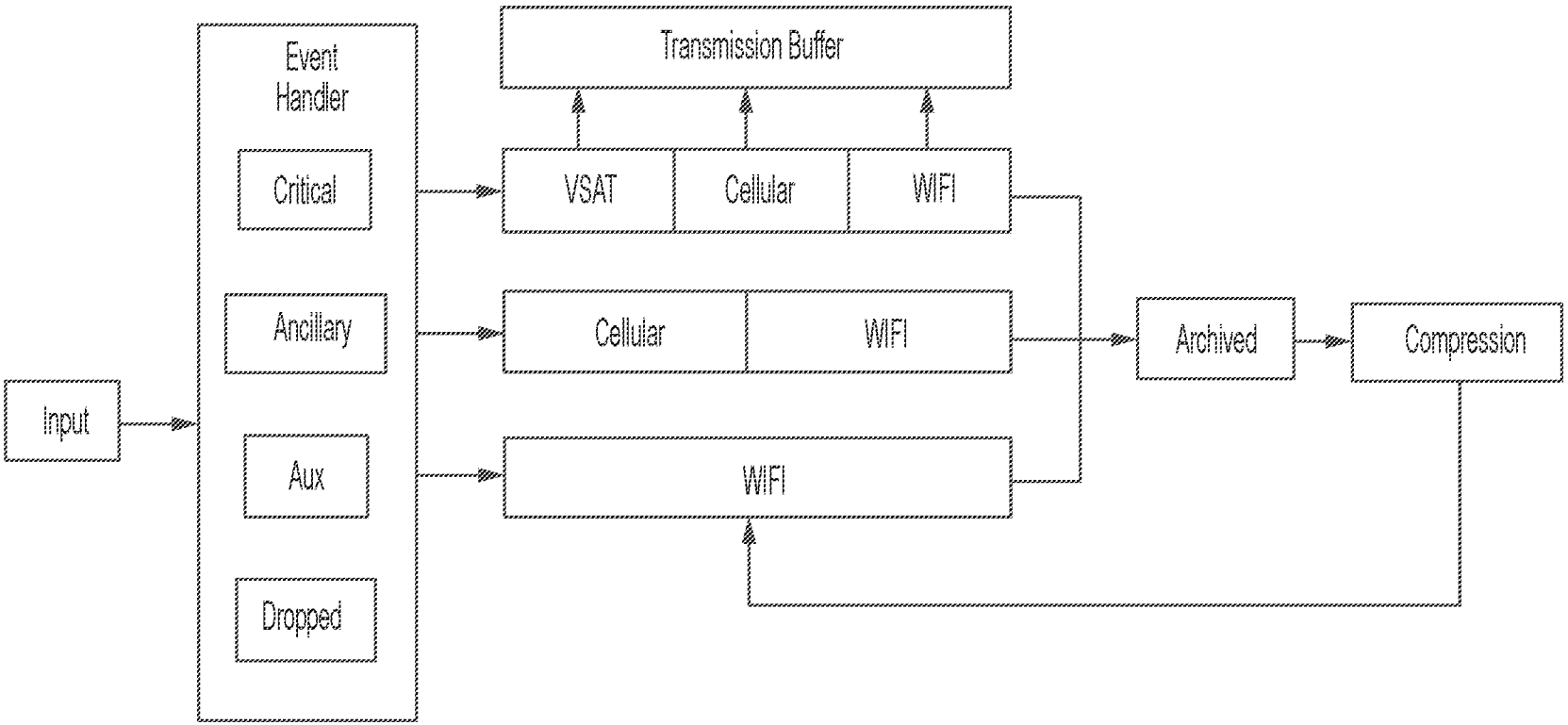
FIG. 3A is a schematic flow chart of event handler module data according to one embodiment of the present invention.
Figure 3B:
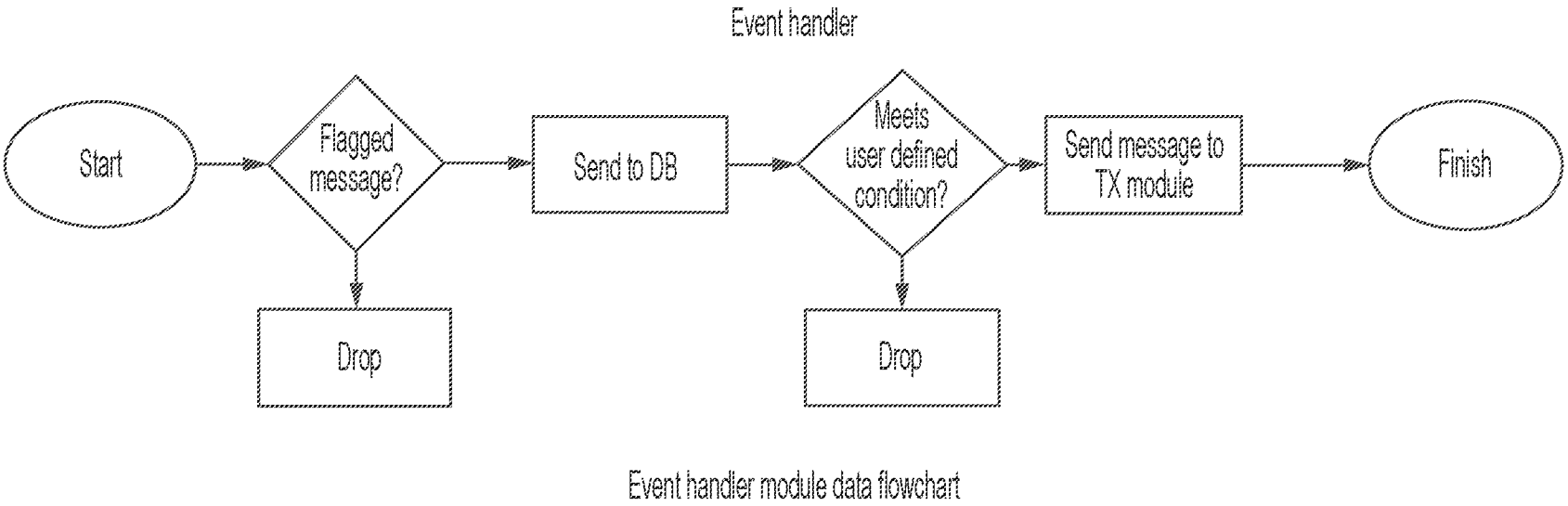
FIG. 3B is a schematic flow chart of event handler module data according to one embodiment of the present invention.
Figure 4:
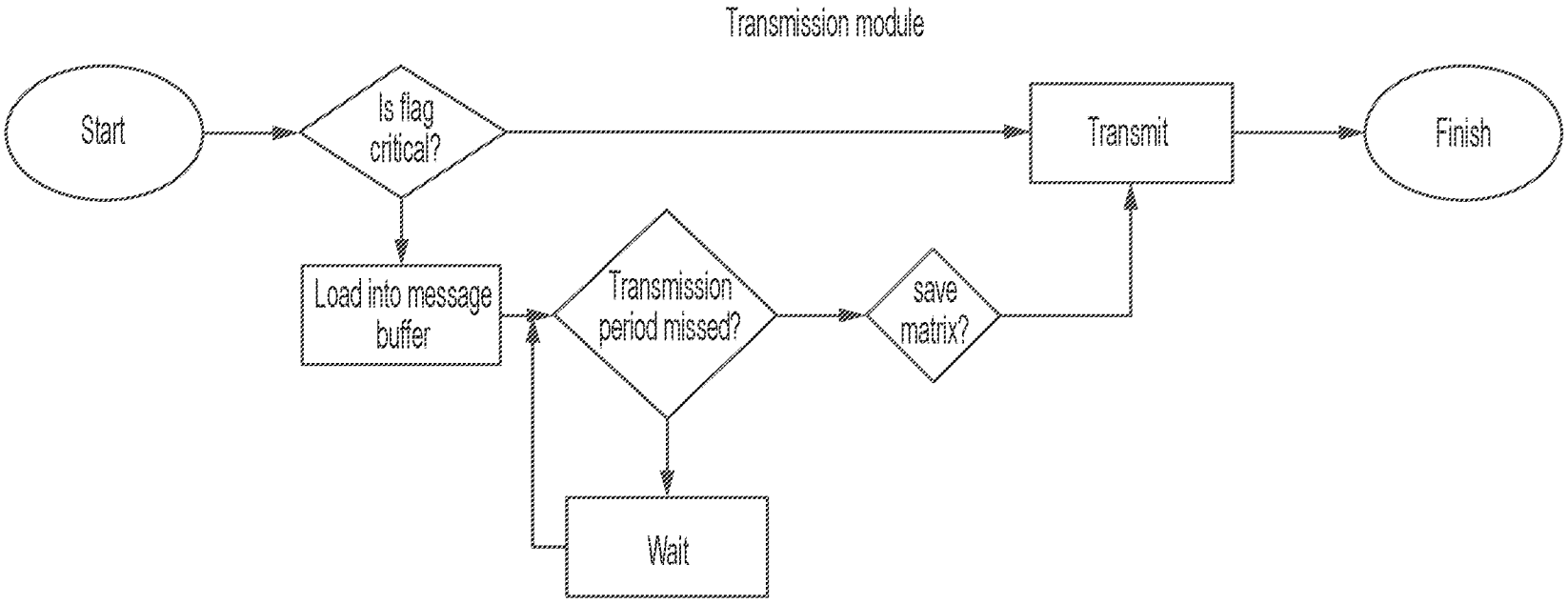
FIG. 4 is a schematic flow chart of a transmission module according to one embodiment of the present invention.
Figure 5A:
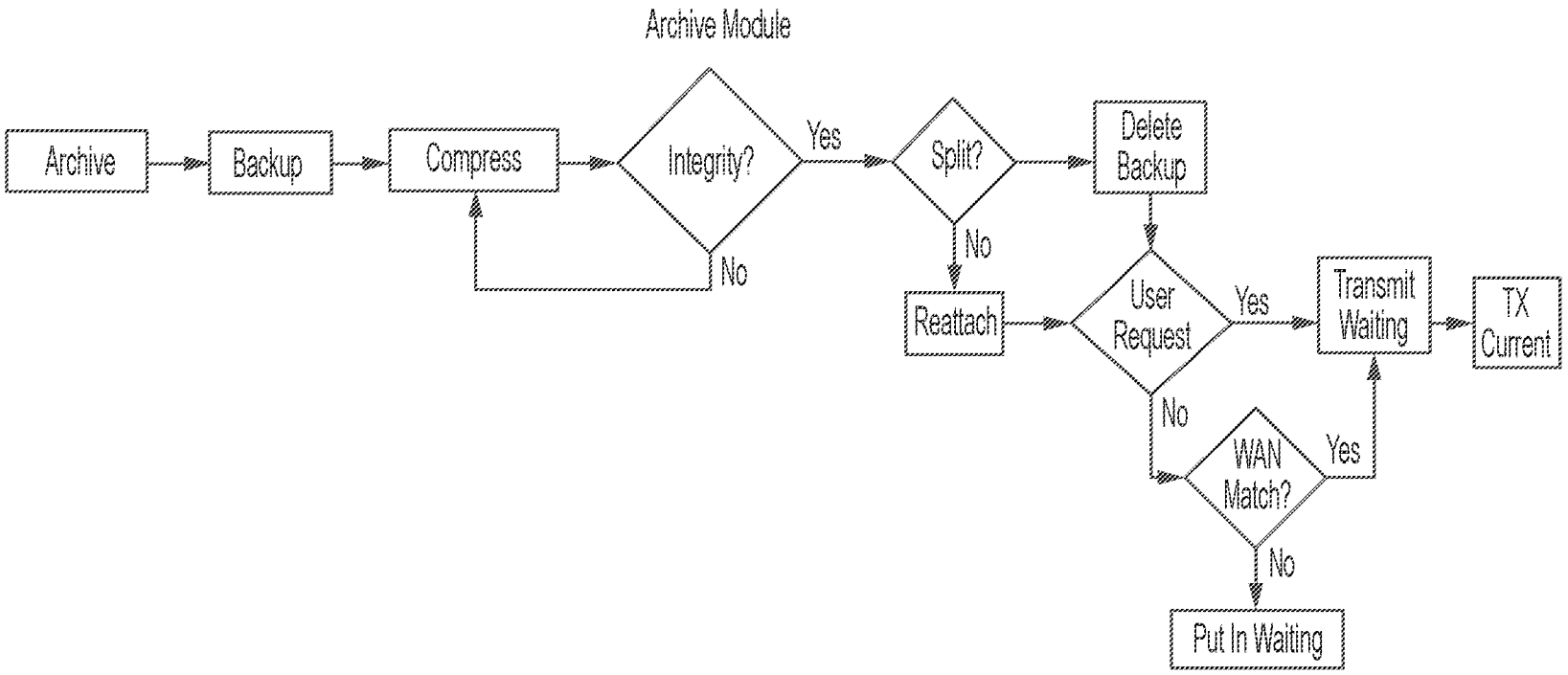
FIG. 5A is a schematic flow chart of a archive module according to one embodiment of the present invention.
Figure 5B:
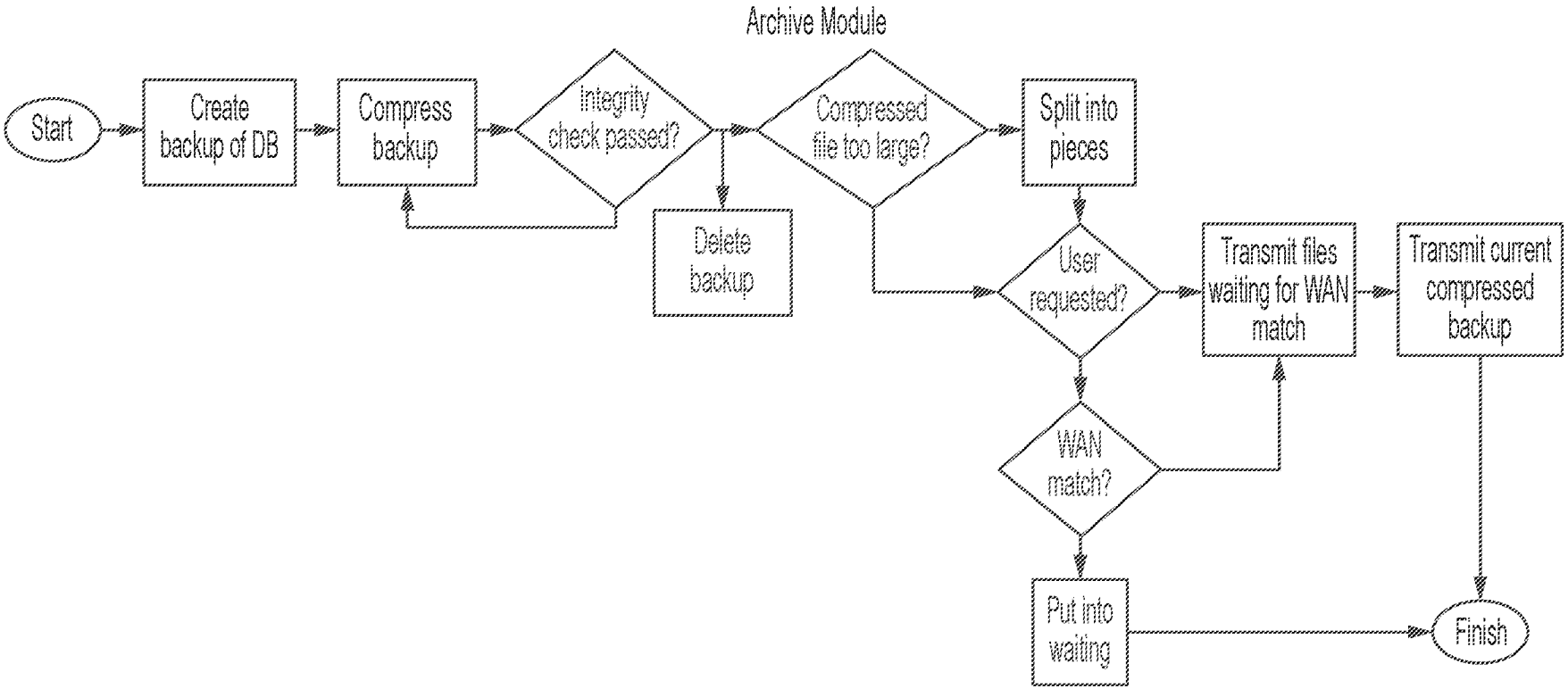
FIG. 5B is a schematic flow chart of a archive module according to one embodiment of the present invention.

The computation module is configured prior to departure according to the selection criteria and order as illustrated, for Example according to a transmission matrix of the type illustrated in FIG. 2. Those skilled in the art will appreciate that the matrix of FIG. 2 is only an example, and that the particular decision matrix that will be used in any particular application can be customized according to the present invention to satisfy the needs and priority of each user. For example, another example is to configure the computation module to transmit data to the transmission buffer in any given iteration according to the decision matrix illustrated in Table 2 below:

TABLE2

| Sensed value >>> Range >>> | Critical low 0-25 | Low 25-40 | Normal 40-60 | High 60-75 | Critical High 75-100 |
|---|---|---|---|---|---|
| Transmission determination | Selection Order: 1-Sat.-Good 2-Sat.-Fair 3-Cell-Good 4-WiFi-good 5-Sat-poor 6-Cell-fair 7-WiFi-fair 8-Cell-fair 9-WiFi-fair | Selection Order: 1-Cell-Good 2-Cell-Fair 3-WiFi-Good 4-WiFi-fair 5-WiFi-poor 6-Cell-poor | Selection Order: 1-WiFi-Good 2-WiFi-Fair | Selection Order: 1-Cell-Good 2-Cell-Fair 3-WiFi-Good 4-WiFi-fair 5-WiFi-poor 6-Cell-poor | Selection Order: 1-Sat.-Good 2-Sat.-Fair 3-Cell-Good 4-WiFi-good 5-Sat-poor 6-Cell-fair 7-WiFi-fair 8-Cell-fair 9-WiFi-fair |

The values sensed for each of the inputs in each zone, and the transmission means used in that zone for each value as a result of the operation of the present invention, is illustrated in the following Table 3:

TABLE 3

| | Engine Oil Temperature | | Engine Temperature | | Hydraulic Pressure | |
|---|---|---|---|---|---|---|
| Zone | Value | Transmission Means | Value | Transmission Means | Value | Transmission Means |
| 1 (Sat. - Good; Cell - Good; WiFi - good) | 50 | WiFi | 10 | Satellite | 70 | Cell |
| 1 (Sat. - Good; Cell - Good; WiFi - good) | 10 | Satellite | 10 | Satellite | 10 | Satellite |
| 2 (Sat. - Good; Cell - Good; WiFi - poor) | 50 | None | 50 | None | 50 | None |
| 2 (Sat. - Good; Cell - Good; WiFi - poor) | 80 | Satellite | 50 | None | 90 | Satellite |
| 3 (Sat. - Good; Cell - Fair; WiFi - No) | 80 | Satellite | 50 | WiFi | 90 | Satellite |
| 3 (Sat. - Good; Cell - Fair; WiFi - No) | 50 | WiFi | 50 | WiFi | 50 | Wifi |
| 4 (Sat. - Fair; Cell - Poor; WiFi - Poor) | 35 | WiFi | 60 | None | 80 | Satelitte |

TABLE 3-continued

| Zone | Engine Oil Temperature | | Engine Temperature | | Hydraulic Pressure | |
|---|---|---|---|---|---|---|
| | Value | Transmission Means | Value | Transmission Means | Value | Transmission Means |
| 5 (Sat. - No; Cell - Poor; WiFi - Good) | 20 | WiFi | 50 | WiFi | 70 | WiFi |
| 6 (Sat. - No; Cell - Poor; WiFi - Good) | 20 | Cellular | 50 | None | 70 | Cellular |

Based on the above, the on-shore server and remote analysis location 20 receives information (including on the user dashboard 21 via the alert system 22) that the each of the zones one or more low or high critical value was detected and transmitted by the present invention, and in response to this information an on-shore expert evaluates all recent data on the vessel that has been stored on the server and based thereon communicates suggested remedial or safety measure to be taken by the captain of the vessel at a time that is temporally proximate to the critical high and critical low events.

A generalize process flow diagram of the operation of the present invention in such an example, as well as in other examples, is provided in connection with FIGS. 3A, 3B, 4, 5A and 5B.

We claim:

1. A system on an operating vessel for transmitting information about a performance of the vessel while in-transit, the system comprising:

at least a first sensor providing information about a performance parameter regarding a status of operation of the vessel or a sub-system of the vessel relating to safety and/or effectiveness;

at least a first communication device, comprising a first network interface card, for wirelessly transmitting a first communication signal to connect a first off-board communication network and for detecting a quality of the connection to said communication network;

at least a second communication device, comprising a second network interface card, for wirelessly transmitting a second communication signal to connect a second off-board communication network and for detecting a quality of the connection to said second communication network, wherein said second communication network is different than said first communication network;

an on-board processor communicatively coupled, directly and/or indirectly, to said at least a first sensor and to each of said at least a first and a second communication devices, wherein said on-board processor executes computer executable instructions to:

receive the information about the performance of the vessel from said at least a first sensor;

prioritize the performance information from said at least a first sensor according to importance to safe and/or effective operation of the vessel;

rank said first communication and second communication signal from each of said first and second communication networks based on at least the quality of said signal of said connection and (i) a cost of using said communication network and/or (ii) a reliability of said communication network; and control transmission of the performance information from said at least a first sensor off-vessel via either said first or second communication network based on said priority and said rank.

2. The system of claim 1, wherein said vessel is a sea-going vessel.

3. The system of claim 2, wherein said at least a first sensor provides information about a potentially failure indicating the performance parameter of said vessel.

4. The system of claim 3, wherein said at least a first sensor provides information about a propulsion system of said vessel.

5. The system of claim 4, wherein said at least a first sensor comprises a first sensor providing information about a first performance parameter regarding the status of operation of the vessel or the sub-system of the vessel and a second sensor providing information about a second performance parameter different than said first parameter and regarding the status of operation of the vessel or the sub-system of the vessel relating to the safety and/or effectiveness of said vessel.

6. The system of claim 4, wherein each of said first communication network and said second communication network is selected from a satellite communication system, a cellular communication system and a WiFi communication system.

7. The system of claim 6, wherein said at least a first sensor comprises at least a first sensor and a second sensor, wherein each sensor provides information about a different performance parameter regarding the status of operation of the vessel or the sub-system of the vessel relating to the safety and/or effectiveness and wherein said on-board processor is communicatively coupled, directly and/or indirectly, to each of said first and second sensors, and wherein said on-board processer prioritizes the performance information from each of said first and second sensors according to importance to the safe and/or effective operation of the vessel.

* * * * *